United States Patent [19]

Brammer

[11] Patent Number: 4,696,493

[45] Date of Patent: Sep. 29, 1987

[54] SUBSEA WELLHEAD TIEBACK SYSTEM

[75] Inventor: Norman Brammer, Ventura, Calif.

[73] Assignee: Vetco-Gray Inc., Houston, Tex.

[21] Appl. No.: 872,794

[22] Filed: Jun. 11, 1986

[51] Int. Cl.[4] ..... F16L 37/08

[52] U.S. Cl. ..... 285/3; 166/345; 285/39; 285/308; 285/313; 285/397; 285/920

[58] Field of Search ..... 285/2, 3, 23, 24, 18, 285/27, 39, 307, 308, 313, 377, 371, 397, 420, 913, 370; 166/345, 379, 125

[56] References Cited

U.S. PATENT DOCUMENTS

| | | | |
|---|---|---|---|
| 2,862,560 | 12/1958 | Bostock et al. | 285/23 |
| 3,345,084 | 10/1967 | Hanes et al. | 285/27 |
| 3,477,744 | 11/1969 | Brown | 285/3 |
| 4,181,331 | 1/1980 | Cowan | 285/307 |
| 4,280,719 | 7/1981 | Daniel et al. | 285/377 |
| 4,343,495 | 8/1982 | Nobileau et al. | 285/23 |
| 4,406,324 | 9/1983 | Baugh et al. | 166/125 |
| 4,528,738 | 7/1985 | Galle, Jr. | 285/3 |
| 4,610,465 | 9/1986 | Boyadjieff | 285/3 |
| 4,611,829 | 9/1986 | Hughes | 285/24 |

FOREIGN PATENT DOCUMENTS

| | | | |
|---|---|---|---|
| 2033463 | 5/1960 | United Kingdom | 285/3 |

*Primary Examiner*—Cornelius J. Husar
*Assistant Examiner*—Eric K. Nicholson
*Attorney, Agent, or Firm*—Joseph R. Dwyer

[57] ABSTRACT

A conductor tieback connector (T) thus having a tubular body (12) connectible to the lower end of a conductor or a string of conductors (C), a downwardly extending funnel (20) with two bearing surfaces and a tapered guide (24). The tapered guide (24) aids in initial stabbing of the connector (T) over a wellhead (W) and the two bearing surfaces (26, 30) operate on the outside of the wellhead (W) to force the tieback connector (T) into angular alignment under the influence of the weight of the conductor string. Seals (14, 16), located between the tieback connector (T) and wellhead (W), are compressed with axial movement of the tieback connector (T). A two-piece internal floating bushing (42, 42*a*, 42*b*), threadible (50, 52) on the interior surface of the tieback connector (T), is moved within the interior of the wellhead (W) where locking dogs (46) engage running tool grooves (40) in the bore of the wellhead (W) to clamp the tieback connector (T) onto the wellhead (W).

5 Claims, 3 Drawing Figures

SUBSEA WELLHEAD TIEBACK SYSTEM

BACKGROUND OF THE INVENTION

1. Prior Art

U.S. Pat. No. 4,343,495 entitled "Conductor Tieback Connector" of Nobileau and Jones.

2. Field of Invention

This invention relates to offshore subsea well apparatus and in particular to a connector for connecting a tieback conductor to a wellhead located subsea. More specifically, this invention is an improvement over the tieback connector of the foregoing patent in that the tieback connector of this invention will connect to a wellhead located subsea having internal grooves, often referred to as running tool grooves, on the bore of the wellhead or other tubular member such as a mudline system.

The foregoing patent explained in detail the need for running of tieback conductors from a platform deck to a subsea wellhead. The tubular connector of the foregoing patent utilized a tapered guide (funnel) for initial stabbing and bearing surfaces which operated on the outside surface of the wellhead to force the conductor string into angular alignment with the wellhead under the influence under the weight of the conductor string. Seals located between the tieback connector and the wellhead were compressed with axial movement of the tieback connector and thereafter a lock-down bushing engaged internal running tool threads on the wellhead and clamped the wellhead without the rotation of the conductor.

Such a tieback connector solved angular misalignment problems between the conductor and the wellhead when the conductor approached the wellhead and solved the problem of damage to the seals by the elimination of conductor rotation for makeup.

The tieback connector of the foregoing patent with its lock-down bushing, therein also referred to as a floating bushing, required threads on the internal bore of the wellhead for makeup but with the advent of running tool grooves on the internal bore of the wellhead (in lieu of threads) the patented tieback connector was no longer compatible. Thus, there is a need for a tieback connector capable of function with wellheads having internal running tool grooves yet incorporating all of the other advantages of the patented tieback connector.

In connection with running tool grooves on the copending wellhead, reference is also made to the U.S. Pat. Application of Calder and Cromar, Ser. No. 466,236, filed Feb. 14, 1983 entitled "Conductor Tieback Connector" which also discloses locking dogs engagable in such grooves but in a totally different type of connector.

SUMMARY OF THE INVENTION

The conductor tieback connector in this invention which fulfills the foregoing stated need includes much of the structure of the patented tieback connector so as to have all the advantages thereof. Thus this tieback connector has a tubular body connectible to the lower end of a conductor or a string of conductors, a downwardly extending funnel with two bearing surfaces and a tapered guide. The tapered guide aids in initial stabbing of the connector over the wellhead and the two bearing surfaces operate on the outside of the wellhead to force the tieback connector into angular alignment under the influence of the weight of the conductor string. Seals, located between the tieback connector and wellhead, are compressed with axial movement of the tieback connector.

The tieback connector also includes a two-piece internal floating bushing, threadible on the interior surface of the tieback connector, which is moved within the interior of the wellhead where locking dogs engage running tool grooves in the bore of the wellhead to clamp the tieback connector onto the wellhead.

DETAILED DESCRIPTION

Figure 1:
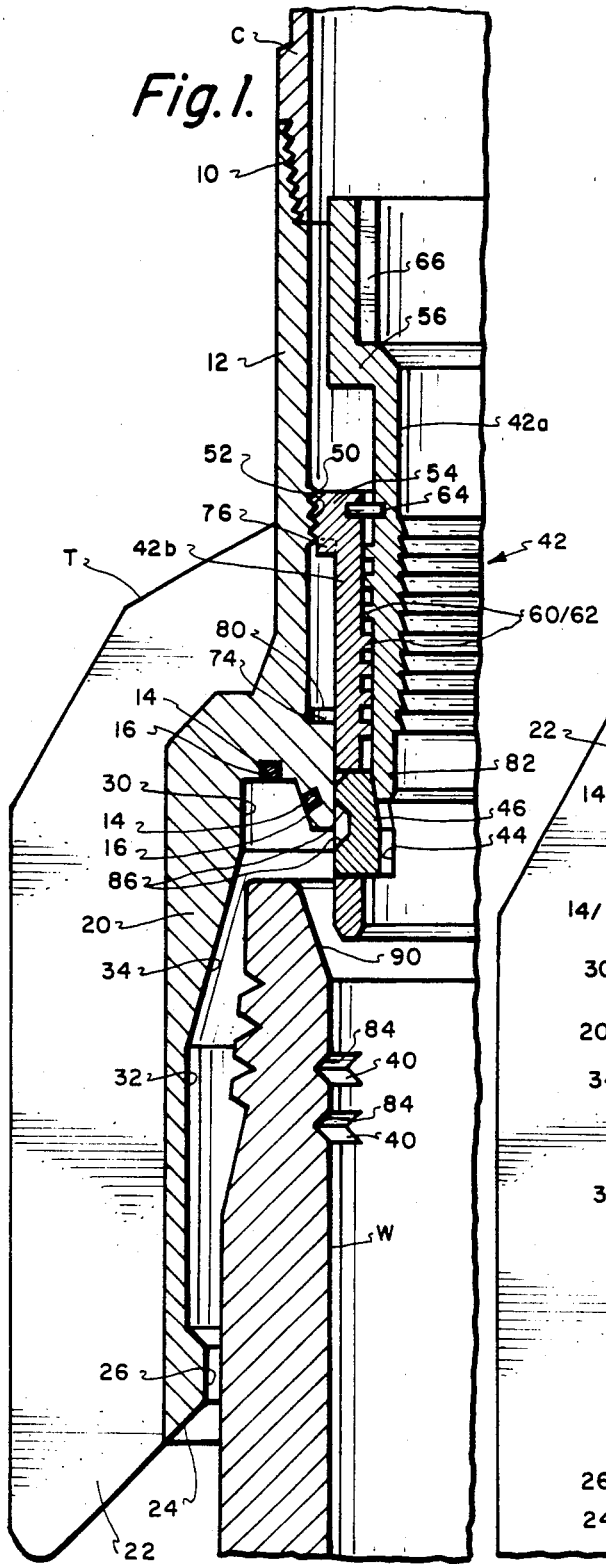
FIG. 1 illustrates the tieback connector as it approaches the wellhead.

In FIG. 1 a wellhead W is located near the seabed (not shown). To tieback the wellhead to a platform, also not shown, an external conductor C is to be connected and sealed to the wellhead W. Conductor C is the lowermost conductor of a string of conductors extending back to the platform and is connected to tieback connector T of this invention in any suitable manner such as threads at 10. The tieback connector T includes an upper tubular body 12, and seal grooves 14 where seal rings 16 may be contained at a location for sealing with the wellhead W.

The lower portion of the tieback connector T is a cylindrical bell-shaped funnel 20 which is securely attached and integral with the tubular body 12. This funnel 20 may include on its outer surface a plurality of guide ribs 22 which are tapered at their lower end faring uniformly into a tapered surface 24 at the lower end of the funnel 20.

If the tieback connector T approaches the wellhead W with some horizontal offset, the lower edge of the guide ribs 22 and the tapered surface 24 interact with the upper edge of the wellhead W. The weight of the conductors forcing the tieback connector T downwardly causes the conductor C and the string of conductors to deflect laterally and circle the wellhead W. The funnel 20 includes a lower bearing surface 26 which has an internal diameter only slightly greater than the outside diameter of the wellhead W. This provides accurate guidance of the lower end of the tieback connector T.

An upper bearing surface 30 also has a diameter only slightly greater than the outside diameter of the wellhead W. The funnel 20 at an intermediate section 32 between the first and second bearing surfaces 26,30 has a diameter greater than that of either of the bearing surfaces 26,30. The diameter of this intermediate section 32 gradually approaches that of the second bearing surface to form an internal conical surface 34.

As the tieback connector is lowered with the first bearing surface 26 engaged, the internal intermediate section 32 rides at the top of the wellhead followed by the conical surface 34 and ultimately the upper bearing surface 30 is engaged. Interaction between the two bearing surfaces 26,30 and the outside surface of the wellhead W applies a bending moment to force the string of conductors into alignment with the wellhead W. The weight of the conductors applies the driving force which may be augmented with a connector tool described hereinafter. Selection of tolerances between the various diameters should be such that this forces axial alignment within preferably 0.1 degrees.

At this time the abutting surfaces of the wellhead W and the tieback connector contact in the area of the seals 16 which are compressed against the upper surface (end) of the wellhead W. Only the weight of the conductor string operates to initially compress the seals.

Thus far described, the tieback connector T functions with the conductor C and wellhead W in the same manner as the patented tieback connector of Nobileau and Jones, supra. However, in this instance, the bore of the wellhead W contains grooves 40 used for any purpose, running tool grooves being shown, making the patented tool incompatible with the wellhead W since the patented connector has a floating bushing with a set of external threads for coupling with internal threads in the bore of the wellhead. However, to be compatible with running tool grooves 40, the floating bushing 42 of this invention comprises two pieces or rings; inner ring 42*a* and outer ring 42*b*. Outer ring 42*b* has openings 44 which contain dogs 46 (one shown) adapted to mate with the grooves 40. The outer ring 42*b* also includes upper external threads 50 which mate with upper internal threads 52 on the upper tubular body 12. Threads 50 are located on radially outwardly extending rim 54 on the top of the outer ring 42*b* and inner ring 42*a* has an offset 56 to accommodate the thickness of outer ring 42*b*. Also both rings overlap and are connected together by complementary square threads 60, 62 on the inner and outer rings, respectively.

These upper threads 50,52 operate to support the two-piece floating bushing 42 in a withdrawn and protected position during running of the conductor. See FIGS. 1 and 2. Prior to sealably connecting the tieback connector T to the conductor C, the two-piece floating bushing, inserted from the top of the connector T, is rotated to engage threads 50 with threads 52 on the upper body member 12. Shear pins 64 (one shown) prevent initial relative rotation between rings 42*a* and 42*b* so that rotation of ring 42*a* will thread ring 42*b* onto the connector threads 52. The inside diameter of the tieback connector below the threads 50,52 is greater than the outside diameter of the threads 50 so that the ring 42*b* may be rotated to pass beyond the threads 50,52.

Figure 3:
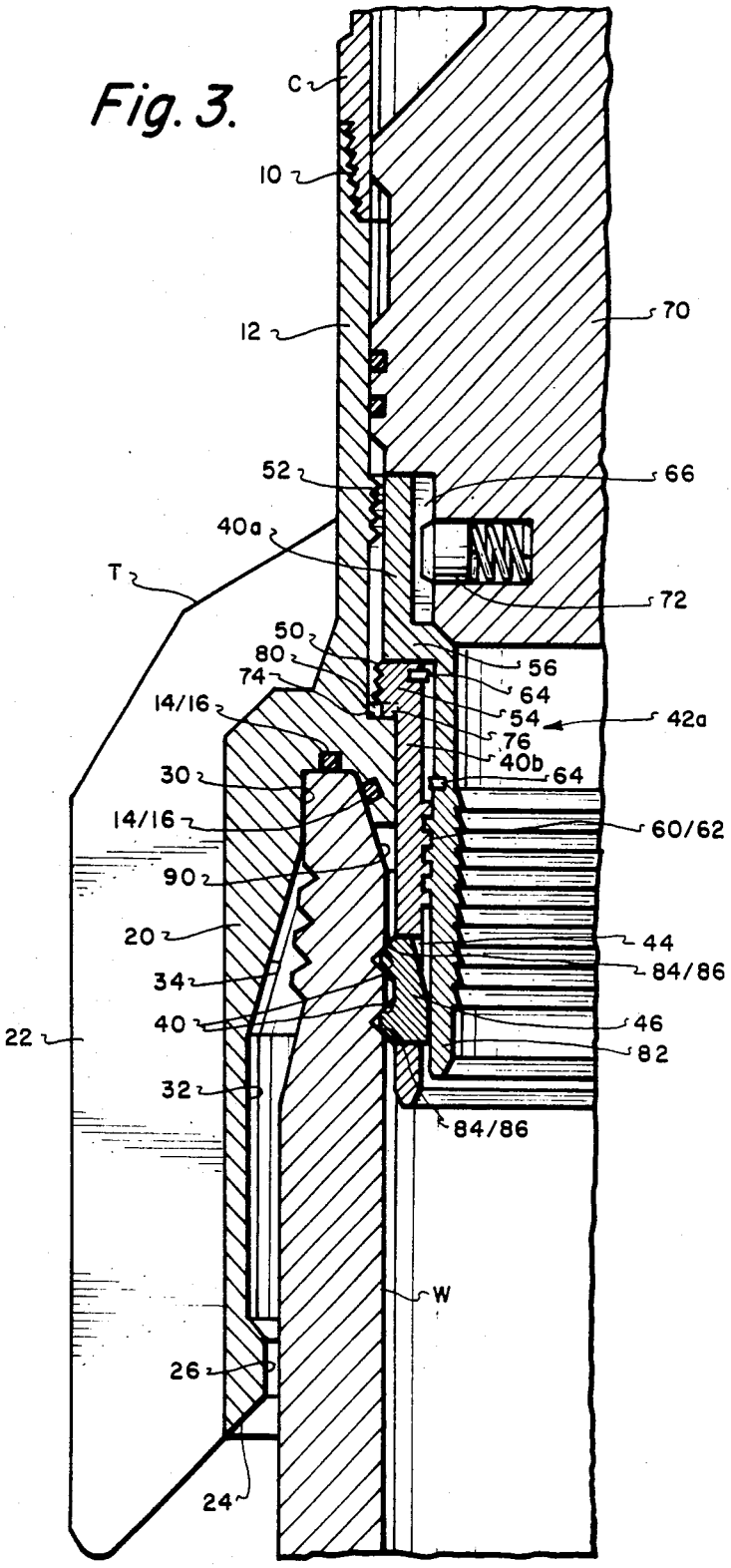
FIG. 3 illustrates the tubular connector as fully made up.

The two-piece bushing 42 also includes vertical slots 66 (one shown) on inner ring 42*a* which provide a means for interlocking the bushing 42 with a rotating tool 70, shown in FIG. 3. This rotating tool 70 includes spring-activated latches 72 which engage the vertical slots 66. A tubing string carrying rotating tool 70 may be run down and the tool used to rotate the entire two-piece bushing 42 thereby releasing the bushing from its upper position. The longitudinal spacing of the threads 52 is such that the two-piece bushing 42 is released from engagement before the rim 54 engages an upwardly facing ledge 74 formed in the tieback connector T shown in FIG. 3 in the area between the upper tubular body member 12 and the top of the funnel 20. This provides a floating position of the two-piece bushing which facilitates engagement of downwardly extending lugs 76 in the bottom of rim 54 with complementary upwardly extending lugs 80 on the ledge 74 in an interdigitized relationship. This engagement prevents further rotational movement of the outer ring 42*b*, further downward movement of said outer ring 42*b*, and almost aligns the locking dogs 46 with grooves 40 in the well bore. Further rotation of the inner ring 42*a* fractures the shear pins 64 allowing the inner ring 42*a* to thread downwardly on threads 60,62 where the lower tapered tip 82 on the inner ring 42*a* engages and urges the locking dogs 46 into tight engagement in the grooves 40. Tapered complementary edges 84,86 on the grooves and dogs, respectively, serve to compress the connector T against the wellhead W and thus bring the connector T into precise alignment and further compress the seals 14,16. This brings the connector into precise alignment through the interaction of a slope 90 on the wellhead W.

Figure 2:
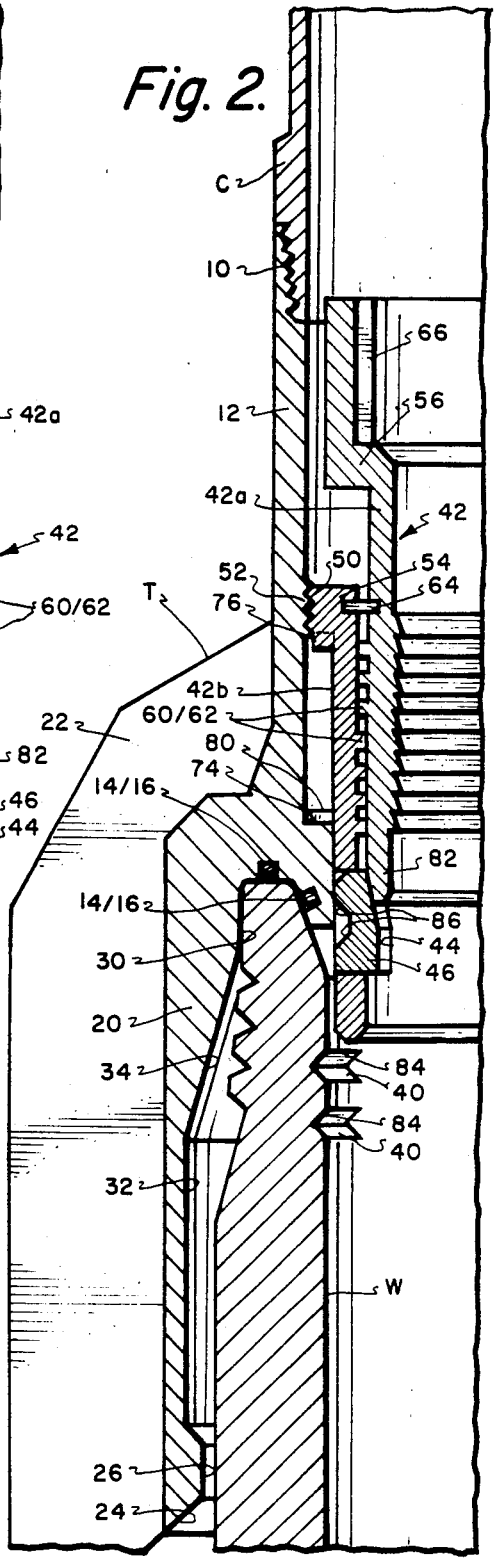
FIG. 2 illustrates the tieback connector in the seated position.

In the event, if it is desired to retrieve the connector T, the rotating tool 70 is engaged and rotated in the direction opposite to the rotation for engagement of the connector a sufficient amount to thread the inner ring 42*a* upwardly to a position such as shown in FIGS. 1 and 2 thereby freeing the locking dogs 46 of the grooves 40. An upward pull on the conductor string will then release the connector T.

Finally while the threads 50,52 are shown to require only four turns to unthread, threads 50,52 may extend to a point near the lugs 76, 80 thus reducing the float of the bushing without interfering with the operation of the connector.

I claim:

1. A conductor tieback connector for connecting a conductor to an internally grooved subsea wellhead comprising;

a tubular body sealably and rigidly connectible to the conductor;

a downwardly opening funnel means with internal bearing surfaces for aligning the connector, said funnel means being connected to said tubular body;

internal threads on said tubular body;

abutting surfaces on the wellhead and said tubular body for abutting when said tubular body is fully engaged within the wellhead; and lockdown means comprising, a two-piece bushing located within said tubular body, including external threads on one piece of said bushing engagable with said internal threads on said tubular body, locking means on said other piece of said bushing for engaging said wellhead, means for interlocking said one piece with a rotating tool, means for interlocking both pieces together, means internal of said tubular body and engagable with means on said bushing for preventing downward movement of said bushing relative to said tubular body, and means for preventing rotation of said one piece and for disconnecting said means for interlocking both pieces together whereby said other piece, upon continued rotation, will urge and lock said locking means in said wellhead grooves.

2. The conductor tieback connector as claimed in claim 1 wherein said locking means are locking dogs.

3. A conductor tieback connector for connecting a conductor to an internally grooved subsea wellhead comprising;

a tubular body sealably and rigidly connectible to the conductor;

a downwardly opening funnel means with internal bearing surfaces for aligning the connector, said funnel means being rigidly connected to said tubular body;

internal threads on said tubular body;

abutting surfaces on the wellhead and said tubular body for abutting when said tubular body is fully connected to the wellhead; and lockdown means comprising, a bushing located within said tubular body including an outer ring and an inner ring, external threads on said outer ring engagable with threads on said tubular body, locking means on said inner ring for engaging said wellhead grooves, means for interlocking said inner ring with a rotating tool whereby rotation of said inner ring unthreads the threads on said outer ring from the threads on said tubular body, a shoulder on said inner ring, a ledge formed internally on said tubular body and having means for engaging means on said shoulder of said outer ring for preventing downward movement of the outer ring relative to said tubular body and preventing rotating of said outer ring upon further rotation of said inner ring, internal threads on said outer ring engagable with external threads on said inner ring whereby, as said inner ring rotates, said inner ring moves downwardly by operation of the external and internal threads and moves said locking means into said grooves on said wellhead thereby locking said connector to said wellhead.

4. The connector as in claim 3 wherein said locking means are locking dogs.

5. A connector as in claim 4 wherein seals are located at one of said abutting surfaces to be compressed by axial movement of the connector relative to the wellhead.

* * * * *